US009056713B2

(12) United States Patent
Li et al.

(10) Patent No.: US 9,056,713 B2
(45) Date of Patent: Jun. 16, 2015

(54) CARTRIDGE FOR GLASS SUBSTRATE

(75) Inventors: Xiande Li, Guandong (CN); Chunhao Wu, Guandong (CN); Kunhsien Lin, Guandong (CN); Minghu Qi, Guandong (CN); Zenghong Chen, Guandong (CN); Yongqiang Wang, Guandong (CN); Weibing Yang, Guandong (CN); Zhenhua Guo, Guandong (CN); Yunshao Jiang, Guandong (CN); Zhiyou Shu, Guandong (CN)

(73) Assignee: Shenzhen China Star Optoelectronics Technology Co., Ltd., Shenzhen, Guangdong (CN)

( * ) Notice: Subject to any disclaimer, the term of this patent is extended or adjusted under 35 U.S.C. 154(b) by 428 days.

(21) Appl. No.: 13/640,972

(22) PCT Filed: Aug. 31, 2012

(86) PCT No.: PCT/CN2012/080853

§ 371 (c)(1),
(2), (4) Date: Oct. 12, 2012

(87) PCT Pub. No.: WO2014/032279

PCT Pub. Date: Mar. 6, 2014

(65) Prior Publication Data

US 2014/0061081 A1 Mar. 6, 2014

(30) Foreign Application Priority Data

Aug. 28, 2012 (CN) ..... 2012 1 0310378

(51) Int. Cl.
*B65D 85/48* (2006.01)
*A47G 19/08* (2006.01)

(52) U.S. Cl.
CPC ..... *B65D 85/48* (2013.01)

(58) Field of Classification Search
USPC ..... 206/454, 455, 449; 211/41.18, 41.1, 211/41.14, 43, 175
See application file for complete search history.

(56) References Cited

U.S. PATENT DOCUMENTS

| | | | | |
|---|---|---|---|---|
| 4,727,993 | A * | 3/1988 | Mirkovich et al. | 211/41.18 |
| 6,273,275 | B1 * | 8/2001 | Kim et al. | 211/41.18 |
| 7,163,110 | B2 * | 1/2007 | Huang et al. | 211/41.18 |
| 7,188,736 | B2 * | 3/2007 | Choi | 211/41.18 |
| 7,246,708 | B2 * | 7/2007 | Chuang et al. | 211/41.18 |
| 2004/0200788 | A1 * | 10/2004 | Shon et al. | 211/41.18 |
| 2006/0016709 | A1 * | 1/2006 | Chen et al. | 206/448 |
| 2006/0231515 | A1 * | 10/2006 | Chou | 211/41.18 |
| 2010/0224524 | A1 * | 9/2010 | Yuasa et al. | 206/454 |
| 2014/0097115 | A1 * | 4/2014 | Kuo et al. | 206/454 |

* cited by examiner

*Primary Examiner* — Jacob K Ackun
(74) *Attorney, Agent, or Firm* — Andrew C. Cheng

(57) ABSTRACT

The present invention discloses a cartridge for glass substrate and which includes a top wall, a bottom wall, at least a pair of sidewalls, a plurality of supporting rods, and an adjusting device. The plurality of supporting rods are arranged on the pair of sidewalls along a first horizontal direction across the pair of sidewalls such that a plurality of supporting surfaces configured by at least a pair of supporting rods facing each other from the paid of sidewalls are defined. The adjusting device is used to move one of the sidewall toward the other sidewall with respect to the top and bottom walls so as to change a span between the pair of sidewalls. As a result, the cartridge can be used to accommodate glass substrates with different dimensions.

15 Claims, 3 Drawing Sheets

CARTRIDGE FOR GLASS SUBSTRATE

FIELD OF THE INVENTION

The present invention relates to a technical field of liquid crystal display device, and more particularly, to a cartridge for carrying a glass substrate.

DESCRIPTION OF PRIOR ART

The liquid crystal display panel is generally and temporally stored with a cartridge for glass substrate. A typical prior art cartridge generally includes a rectangular container with a plurality of supporting surfaces thereof. The rectangular container generally includes a pair of sidewalls arranged in parallel to each other, and a pick-up opening is also arranged between the pair sidewalls. The supporting surfaces are vertically and alternatively arranged across the cartridge, and each of the supporting surfaces includes two rows of supporting rods bridged to the sidewalls. When the glass substrate is disposed within the cartridge, each of the supporting rods supports edges of the glass substrate.

However, in the actual practices, there is a plurality of glass substrates with different and customized dimensions. Accordingly, the manufacturer has to prepare a plurality of cartridges corresponding to each of the glass substrate of different dimension.

SUMMARY OF THE INVENTION

It is an object of the present invention to provide a cartridge for glass substrate in which different dimensions of glass substrate can be readily accommodated therein.

In order to resolve the above described issue, the present invention provides a technical solution by introducing a cartridge for glass substrate for storing and supporting glass substrate therein, characterized in that: wherein the cartridge includes a top wall, a bottom wall, at least a pair of sidewalls, a plurality of supporting rods, and an adjusting device, wherein the top wall and the bottom wall are arranged horizontally in parallel with each other. Wherein the pair of sidewalls are arranged vertically and located between the top and bottom walls. Wherein the plurality of supporting rods are arranged on the pair of sidewalls along a first horizontal direction across the pair of sidewalls such that a plurality of supporting surfaces configured by at least a pair of supporting rods facing each other from the paid of sidewalls are defined. Wherein the adjusting device is used to move one of the sidewall toward the other sidewall with respect to the top and bottom walls so as to change a span between the pair of sidewalls. Wherein the adjusting device includes a screw driving one of the sidewall to move along the first horizontal direction between the top and bottom walls; and wherein the top and bottom walls are provided with stopper so as to limit the displacement of the one sidewall toward the other sidewall once the one sidewall reaches to the stopper.

Wherein the adjusting device can drive a pair of sidewalls moving toward or away from each other simultaneously with respect to the top wall and bottom walls.

Wherein the screws includes a first thread section and a second thread section alternatively arranged along the horizontally with the pair of sidewalls coupled thereon, wherein the first thread section and the second thread section are reversed with each other.

Wherein the screw includes a left-handed thread and a right-handed thread, which each of the left-handed and right-handed threads is coupled to one of the sidewall such that when the screw is driven to rotate, the pair of sidewalls are moved toward or away from each other simultaneously.

Wherein that the cartridge includes two pair of sidewalls, and the screw includes a first left-handed thread, a first right-handed thread, a second left-handed thread, and a second right-handed thread, wherein each of the two pair of sidewalls is coupled to the one of the first left-handed thread, the first right-handed thread, the second left-handed thread, and the second right-handed thread of the screw, respectively.

Wherein the adjusting device includes a power source for driving the screw.

Wherein the supporting rods are arranged along a second horizontal direction which is perpendicular to the first horizontal direction.

Wherein the adjusting device is arranged adjacent to the bottom wall.

In order to resolve the above described issue, the present invention provides a technical solution by introducing a cartridge for glass substrate for storing and supporting glass substrate therein, characterized in that wherein the cartridge includes a top wall, a bottom wall, at least a pair of sidewalls, a plurality of supporting rods, and an adjusting device, wherein the top wall and the bottom wall are arranged horizontally in parallel with each other Wherein the pair of sidewalls are arranged vertically and located between the top and bottom walls. Wherein the plurality of supporting rods are arranged on the pair of sidewalls along a first horizontal direction across the pair of sidewalls such that a plurality of supporting surfaces configured by at least a pair of supporting rods facing each other from the paid of sidewalls are defined; and wherein the adjusting device is used to move one of the sidewall toward the other sidewall with respect to the top and bottom walls so as to change a span between the pair of sidewalls.

Wherein the adjusting device can drive a pair of sidewalls moving toward or away from each other simultaneously with respect to the top wall and bottom walls.

Wherein the adjusting device includes a screw driving one of the sidewall to move along the first horizontal direction between the top and bottom walls.

Wherein the screws includes a first thread section and a second thread section alternatively arranged along the first horizontal direction with the pair of sidewalls coupled thereon, wherein the first thread section and the second thread section are reversed with each other.

Wherein the screw includes a left-handed thread and a right-handed thread, which each of the left-handed and right-handed threads is coupled to one of the sidewall such that when the screw is driven to rotate, the pair of sidewalls are moved toward or away from each other simultaneously.

Wherein that the cartridge includes two pair of sidewalls, and the screw includes a first left-handed thread, a first right-handed thread, a second left-handed thread, and a second right-handed thread, wherein each of the two pair of sidewalls is coupled to the one of the first left-handed thread, the first right-handed thread, the second left-handed thread, and the second right-handed thread of the screw, respectively.

Wherein the adjusting device includes a power source for driving the screw.

Wherein the top and/or bottom walls are provided with stopper so as to limit the displacement of the one sidewall toward the other sidewall once the one sidewall reaches to the stopper.

Wherein the supporting rods are arranged along a second horizontal direction which is perpendicular to the first horizontal direction Wherein the adjusting device is arranged adjacent to the bottom wall.

The present invention can be concluded with the following advantages. As compared with the existing technologies, the cartridge for glass substrate provided by the present invention can readily move at least one of a sidewall with respect to the other between the top and bottom walls such a distance between the two walls can be readily adjusted so as to accommodate the glass substrates with different dimensions. Accordingly, it can readily meet the requirements for accommodating different glass substrates with a single cartridge.

DETAILED DESCRIPTION OF PREFERRED EMBODIMENT

Figure 1:
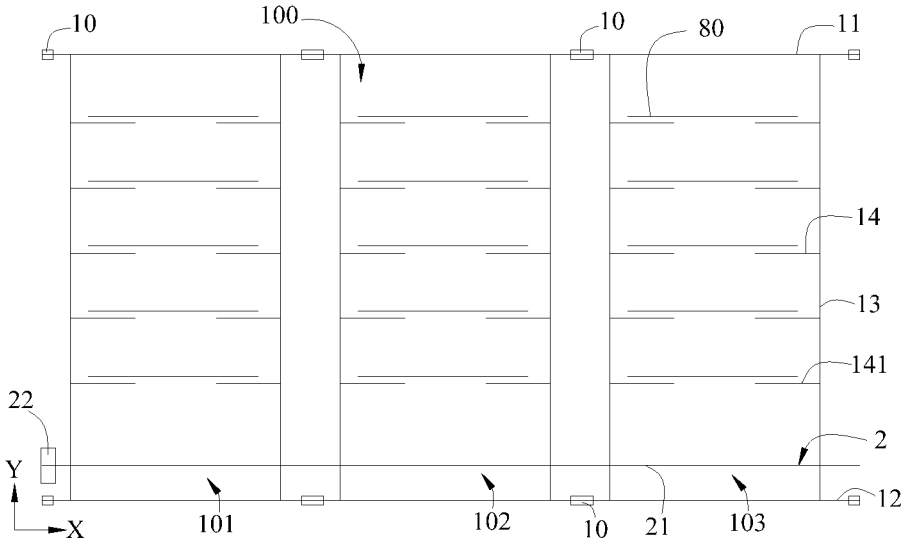
FIG. 1 is a front elevational view of a cartridge for glass substrate made in accordance with the present invention in which a plurality of glass substrates of larger dimension are stored therein.

Referring to FIGS. 1 to 4, the cartridge 100 for glass substrate 80, 81 with different dimensions is illustrated. The cartridge 100 generally includes a top wall 11, a bottom wall 12, at least a pair of sidewalls 13, a plurality of supporting rods 14, and an adjusting device 2.*s*

The top wall 11 and the bottom wall 12 are arranged in parallel and with a preset distance therebetween, and also in parallel to a horizontal direction X. In the current embodiment, there is three pair of sidewall walls 13 which are perpendicular to the top wall 11 and the bottom wall 12. The sidewalls 13 are arranged vertically with respect to the first horizontal direction X and are located between the top wall 11 and the bottom wall 12.

In the actual application, the number of the pair of the sidewalls 13 is not limited to merely three as what disclosed above. In addition, the top wall 11 and the bottom wall 12 are not limited to any certain configuration. For example, the top wall 11, bottom wall 12 and the sidewalls 13 can be embodied as a plate-like configuration, or a doorframe-like configuration. The top wall 11 and the bottom wall 12 can be readily secured by a supporting wall (not shown in Figure) extending along the vertical direction Y. On the other hand, the top wall 11 and the bottom wall 12 can be simply configured by the sidewall 13.

The top wall 11, the bottom wall 12 and any one of the three pair of sidewalls 13 jointly configure the storing cells 101, 102, and 103 for storing glass substrate. The plurality of supporting rods 14 are sequentially supported onto the sidewall 13. In addition, the supporting rods 14 extend along the first horizontal direction X from its on rooted sidewall 13 to face each other so as to configure a plurality of supporting surfaces 141, 142 for supporting the glass substrate 80 and 81.

Figure 2:
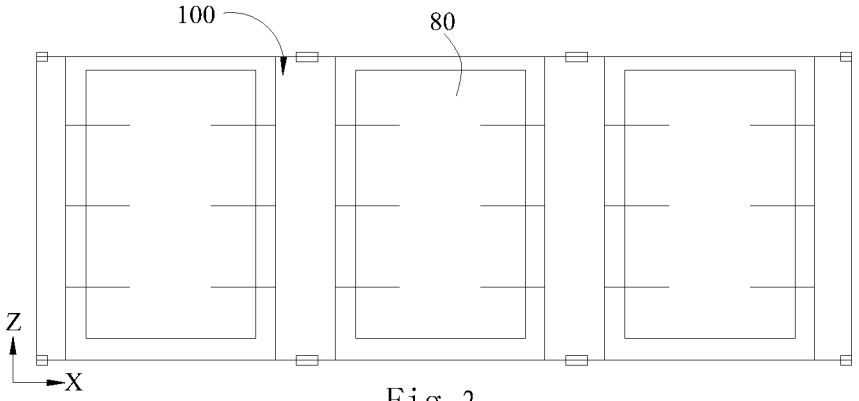
FIG. 2 is a top view of the cartridge for glass substrate shown in FIG. 1 showing the glass substrates with larger dimensions are stored therein.
Figure 4:
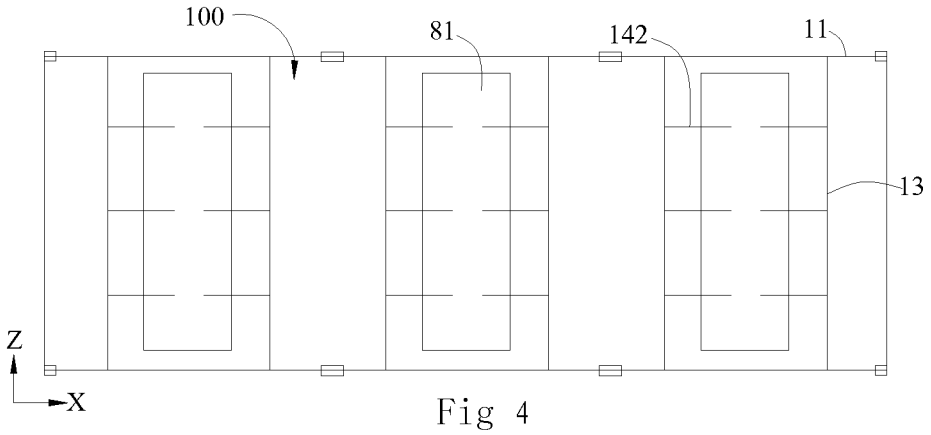
FIG. 4 is a top view of the cartridge for glass substrate shown in FIG. 3 showing the glass substrates with smaller dimensions are stored therein.

In the actual application, the interengagement of the supporting rods 14 and the sidewall 13 can be implemented with different ways and manners. For example, the supporting rods 14 and the sidewall 13 can be integrally formed, or the interengagement can be facilitated by means of rivet, welding, and bolting etc. Referring to FIGS. 2 and 4, in the current embodiment, the supporting rods 14 are embodied as an elongated rod, and are securely attached to the sidewalls 13. In addition, the supporting rods 14 extend along a second horizontal direction X so as to expand into the supporting surfaces. In the actual embodiment, the supporting rods 14 can be embodied as a supporting board.

Figure 5:
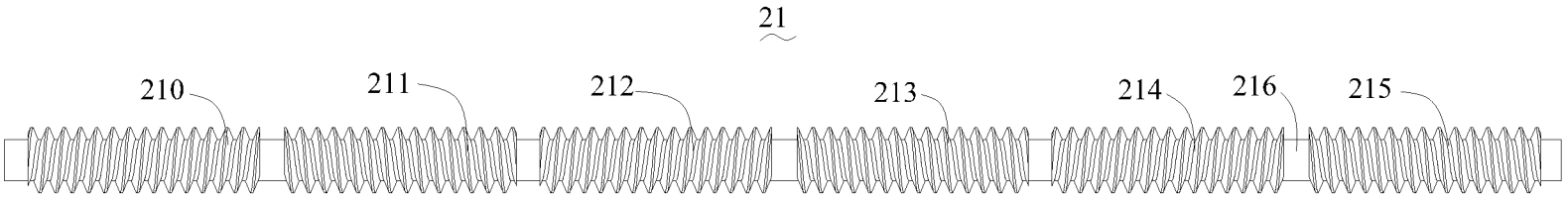
FIG. 5 is a front elevational view of a screw used in the cartridge shown in FIG. 1.
Figure 6:
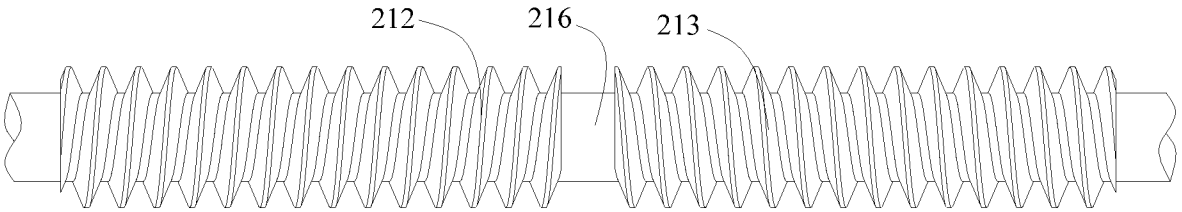
FIG. 6 is an enlarged view of the screw shown in FIG. 5.

Referring to FIGS. 5 and 6, in this embodiment, the adjusting device 2 is shown, and it includes a screw 21 and a power source 22.

The screw 21 includes a left-handed thread, a right-handed thread, and a intersection 216. Substantially, the left-handed thread includes a first left-handed thread 210, a second left-handed thread 212, and a third left-handed thread 214; while the right-handed thread includes also a first right-handed thread 211, a second right-handed thread 213, and a third right-handed thread 215. The first left-handed thread 210 and the first right-handed thread 211 are separated with the intersection 216; the second left-handed thread 212 and the second right-handed thread 213 are also separated with the intersection 216; and the third left-handed thread 214 and the third right-handed thread 215 are separated with the intersection 216.

Each one of the sidewall of those three pairs of sidewalls 13 which configure the storing cells 101, 102 and 103 is coupled to the first left-handed thread 210 and the first right-handed thread 211; the second left-handed thread 212 and the second right-handed thread 213; and the third left-handed thread 214 and the third right-handed thread 215 respectively and sequentially.

Let take the storing cell 101 as an example. As shown in FIGS. 1 and 2, when the power source 22 is driving the screw 31 to rotate clockwise, then the sidewalls 13 configuring the storing cell 101 will be moved away from each other along the first horizontal direction X by the operation and rotation of the first left-handed thread 210, and the first right-handed thread 211. Accordingly, the span of the storing cell 101 is enlarged along the first horizontal direction X. Accordingly, the glass substrate 80 with larger dimension can be readily supported by the supporting surfaces 141 configured by the supporting rods 14.

Figure 3:
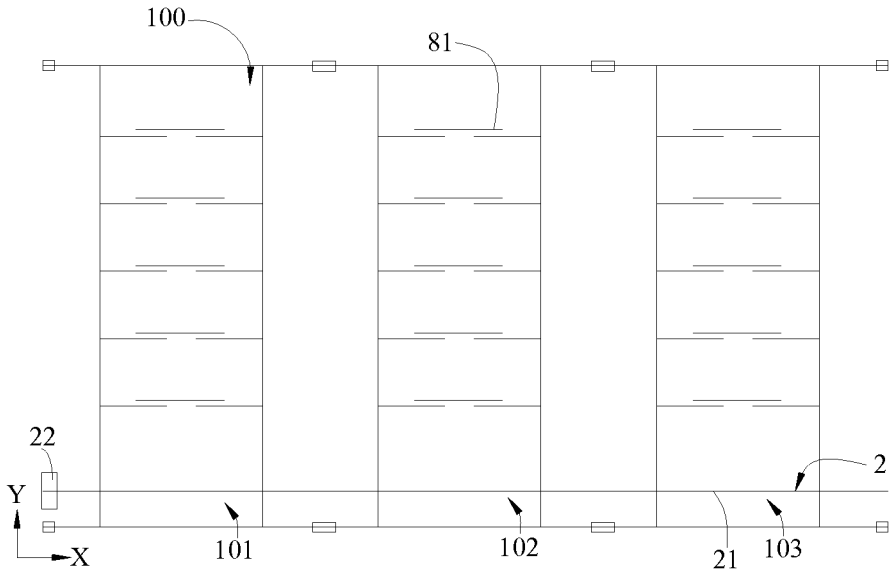
FIG. 3 is a front elevational view of a cartridge shown in FIG. 1 in which a plurality of glass substrates of smaller dimension are stored therein.

Referring to FIGS. 3 and 4, when the power source 22 is driving the screw 31 to rotate counterclockwise, then the sidewalls 13 configuring the storing cell 101 will be moved toward each other along the first horizontal direction X by the operation and rotation of the first left-handed thread 210, and the first right-handed thread 211. Accordingly, the span of the storing cell 101 is narrowed along the first horizontal direction X. Accordingly, the glass substrate 81 with larger dimension can be readily supported by the supporting surfaces 142 configured by the supporting rods 14.

The storing cells 102 and 103 can be readily adjusted with the same manner along the first horizontal direction such as described with respect to the storing cell 101. Accordingly, no further description is given. Meanwhile, once the span of each of the storing cells 101, 102 and 103 are increased, then the gap between two neighboring storing cells is narrowed accordingly. And vise versa, once the span is narrowed, the gap will be increased.

Even in the current embodiment, the storing cells are adjusted with the same screw 21, however, in the actual application, different storing cells can be adjusted by different screws along the first horizontal direction X in a way that different cell can be adjusted with different spans so as to accommodate the glass substrates with different dimensions, i.e. glass substrates 80, and 81. As a result, a single cartridge 100 can readily accommodate with glass substrates with different dimensions.

Even the screw 21 is incorporated with the left-handed thread, and the right-handed thread, it can be readily understood that the screw 21 can be incorporated with only the left-handed thread or the right-handed thread. Let take the cartridge 100 configured with a plurality of storing cells as an example. The plurality of storing cells will be adjusted along the first horizontal direction X by the screw 21 which includes only the left-handed thread or the right-handed thread. Intersection between the left-handed thread or right-handed thread is coupled to one of the sidewalls. Each of the thread portions is set to corresponding sidewalls. Preferably, the left or right thread portion is coupled to the same sidewall of each pair of the sidewalls such that all the coupled sidewall 13 will be moved simultaneously and synchronically with respect to the top wall 11 and the bottom wall 12. As a result, the span of each of the storing cells will be moved under control. Preferably, the sidewall 13 which is not coupled with the thread can be reliably interconnected to the top wall 11 and the sidewall 12.

In addition, the screw 21 can be embodied with other preferable form. For a cartridge configured with two storing cells, the screw 21 can be included with the left-handed thread and the right-handed thread which can be coupled to the sidewalls which are moving toward each other, or coupled to the sidewalls moving away from each other. As a result, the span of each of the storing cells can be readily adjusted along the first horizontal direction X.

In the above description, with the operation of the adjusting device 2, the sidewall 13 which is moveably adjusted with the top wall 11 and the bottom wall 12 can be fixedly interconnect to the top wall 11 and the bottom wall 12 instead. Meanwhile, the top wall 11 and the bottom wall 12 are provided with a stopper 10 which can prevent the sidewall 13 from any additional movement with respect to the top wall 11 and the sidewall 12 once the sidewall 13 reaches to the stopper 10. In the actual application, the stopper 10 can be selectively disposed on the top wall 11 or the bottom wall 12.

In the current embodiment, the adjust device 2 is arranged adjacent to the bottom wall 12. In the actual application, the adjusting device 2 can be disposed at any convenient position as long as it can facilitate its intended purpose.

As compared with the existing technologies, the cartridge 100 for glass substrate provided by the present invention can readily move at least one of a sidewall 13 along the first horizontal direction X with respect to the other between the top and bottom walls 11, 12 such a distance between the two walls can be readily adjusted so as to accommodate the glass substrates with different dimensions. Accordingly, it can readily meet the requirements for accommodating different glass substrates with a single cartridge.

Embodiments of the present invention have been described, but not intending to impose any unduly constraint to the appended claims. Any modification of equivalent structure or equivalent process made according to the disclosure and drawings of the present invention, or any application thereof, directly or indirectly, to other related fields of technique, is considered encompassed in the scope of protection defined by the claims of the present invention.

The invention claimed is:

1. A cartridge for glass substrate for storing and supporting glass substrate therein, wherein the cartridge includes a top wall, a bottom wall, at least a pair of sidewalls, a plurality of supporting rods, and an adjusting device, wherein the top wall and the bottom wall are arranged horizontally in parallel with each other;

wherein the pair of sidewalls are arranged vertically and located between the top and bottom walls;

wherein the plurality of supporting rods are arranged on the pair of sidewalls along a first horizontal direction across the pair of sidewalls such that a plurality of supporting surfaces configured by at least a pair of supporting rods facing each other from the paid of sidewalls are defined;

wherein the adjusting device is used to move one of the sidewall toward the other sidewall with respect to the top and bottom walls so as to change a span between the pair of sidewalls;

wherein the adjusting device includes a screw driving one of the sidewall to move along the first horizontal direction between the top and bottom walls;

wherein the top and bottom walls are provided with stopper so as to limit the displacement of the one sidewall toward the other sidewall once the one sidewall reaches to the stopper; and wherein the screws includes a first thread section and a second thread section alternatively arranged along the horizontally with the pair of sidewalls coupled thereon, wherein the first thread section and the second thread section are reversed with each other.

2. The cartridge for glass substrate as recited in claim 1, characterized in that the adjusting device can drive a pair of sidewalls moving toward or away from each other simultaneously with respect to the top wall and bottom walls.

3. The cartridge for glass substrate as recited in claim 1, characterized in that the adjusting device includes a power source for driving the screw.

4. The cartridge for glass as recited in claim 1, characterized in that the supporting rods are arranged along a second horizontal direction which is perpendicular to the first horizontal direction.

5. The cartridge for glass substrate as recited in claim 1, characterized in that the adjusting device is arranged adjacent to the bottom wall.

6. A cartridge for glass substrate for storing and supporting glass substrate therein, wherein the cartridge includes a top wall, a bottom wall, at least a pair of sidewalls, a plurality of supporting rods, and an adjusting device, wherein the top wall and the bottom wall are arranged horizontally in parallel with each other;

wherein the pair of sidewalls are arranged vertically and located between the top and bottom walls;

wherein the plurality of supporting rods are arranged on the pair of sidewalls along a first horizontal direction across the pair of sidewalls such that a plurality of supporting surfaces configured by at least a pair of supporting rods facing each other from the paid of sidewalls are defined;

wherein the adjusting device is used to move one of the sidewall toward the other sidewall with respect to the top and bottom walls so as to change a span between the pair of sidewalls;

wherein the adjusting device includes a screw driving one of the sidewall to move along the first horizontal direction between the top and bottom walls;

wherein the top and bottom walls are provided with stopper so as to limit the displacement of the one sidewall toward the other sidewall once the one sidewall reaches to the stopper; and wherein the screw includes a left-handed thread and a right-handed thread, which each of the left-handed and right-handed threads is coupled to one of the sidewall such that when the screw is driven to rotate, the pair of sidewalls are moved toward or away from each other simultaneously.

7. The cartridge for glass substrate as recited in claim 6, characterized in that the cartridge includes two pair of sidewalls, and the screw includes a first left-handed thread, a first right-handed thread, a second left-handed thread, and a second right-handed thread, wherein each of the two pair of sidewalls is coupled to the one of the first left-handed thread, the first right-handed thread, the second left-handed thread, and the second right-handed thread of the screw, respectively.

8. A cartridge for glass substrate for storing and supporting glass substrate therein, wherein the cartridge includes a top wall, a bottom wall, at least a pair of sidewalls, a plurality of supporting rods, and an adjusting device, wherein the top wall and the bottom wall are arranged horizontally in parallel with each other;

wherein the pair of sidewalls are arranged vertically and located between the top and bottom walls;

wherein the plurality of supporting rods are arranged on the pair of sidewalls along a first horizontal direction across the pair of sidewalls such that a plurality of supporting surfaces configured by at least a pair of supporting rods facing each other from the paid of sidewalls are defined;

wherein the adjusting device is used to move one of the sidewall toward the other sidewall with respect to the top and bottom walls so as to change a span between the pair of sidewalls;

wherein the adjusting device includes a screw driving one of the sidewall to move along the first horizontal direction between the top and bottom walls; and wherein the screws includes a first thread section and a second thread section alternatively arranged along the first horizontal direction with the pair of sidewalls coupled thereon, wherein the first thread section and the second thread section are reversed with each other.

9. The cartridge for glass substrate as recited in claim 8, characterized in that the adjusting device can drive a pair of sidewalls moving toward or away from each other simultaneously with respect to the top wall and bottom walls.

10. The cartridge for glass substrate as recited in claim 8, characterized in that the adjusting device includes a power source for driving the screw.

11. The cartridge for glass substrate as recited in claim 8, wherein the top and/or bottom walls are provided with stopper so as to limit the displacement of the one sidewall toward the other sidewall once the one sidewall reaches to the stopper.

12. The cartridge for glass as recited in claim 8, characterized in that the supporting rods are arranged along a second horizontal direction which is perpendicular to the first horizontal direction.

13. The cartridge for glass substrate as recited in claim 8, characterized in that the adjusting device is arranged adjacent to the bottom wall.

14. A cartridge for glass substrate for storing and supporting glass substrate therein, wherein the cartridge includes a top wall, a bottom wall, at least a pair of sidewalls, a plurality of supporting rods, and an adjusting device, wherein the top wall and the bottom wall are arranged horizontally in parallel with each other;

wherein the pair of sidewalls are arranged vertically and located between the top and bottom walls;

wherein the plurality of supporting rods are arranged on the pair of sidewalls along a first horizontal direction across the pair of sidewalls such that a plurality of supporting surfaces configured by at least a pair of supporting rods facing each other from the paid of sidewalls are defined;

wherein the adjusting device is used to move one of the sidewall toward the other sidewall with respect to the top and bottom walls so as to change a span between the pair of sidewalls; and wherein the adjusting device includes a screw driving one of the sidewall to move along the first horizontal direction between the top and bottom walls;

wherein the screw includes a left-handed thread and a right-handed thread, which each of the left-handed and right-handed threads is coupled to one of the sidewall such that when the screw is driven to rotate, the pair of sidewalls are moved toward or away from each other simultaneously.

15. The cartridge for glass substrate as recited in claim 14, characterized in that the cartridge includes two pair of sidewalls, and the screw includes a first left-handed thread, a first right-handed thread, a second left-handed thread, and a second right-handed thread, wherein each of the two pair of sidewalls is coupled to the one of the first left-handed thread, the first right-handed thread, the second left-handed thread, and the second right-handed thread of the screw, respectively.

* * * * *